United States Patent [19]

Voss et al.

[11] Patent Number: 4,610,593

[45] Date of Patent: Sep. 9, 1986

[54] DEVICE FOR CONVEYING AND STACKING SHEETS OF PAPER

[75] Inventors: Peter Voss, Jüchen; Dieter Osburg, Neuss, both of Fed. Rep. of Germany

[73] Assignee: Jagenberg AG, Dusseldorf, Fed. Rep. of Germany

[21] Appl. No.: 610,360

[22] Filed: May 14, 1984

[30] Foreign Application Priority Data

May 13, 1983 [DE] Fed. Rep. of Germany ..... 3317515

[51] Int. Cl.[4] ..... B65H 31/30

[52] U.S. Cl. ..... 414/43; 414/91

[58] Field of Search ..... 198/422, 575, 579; 414/43, 49, 91; 271/69, 198, 199, 202, 203, 268, 277, 275

[56] References Cited

U.S. PATENT DOCUMENTS 2,261,972 11/1941 Matthews ..... 271/202 X
3,595,564 7/1971 De Young ..... 271/202 X
3,671,034 6/1972 De Ridder ..... 414/43 X
4,297,066 10/1981 Ramcke et al. ..... 414/43

FOREIGN PATENT DOCUMENTS 3114414 10/1982 Fed. Rep. of Germany .
969274 9/1964 United Kingdom ..... 198/422

*Primary Examiner*—Leslie J. Paperner
*Assistant Examiner*—Janice Krizek
*Attorney, Agent, or Firm*—Sprung Horn Kramer & Woods

[57] ABSTRACT

A device for conveying and stacking sheets of paper has a first conveying unit receptive of sheets for stacking and a second conveying unit downstream of the first conveying unit for removing a stack and wherein the units include upper and lower belts. A single upper belt is associated with two lower belts for the two units and the upper belt is alternately coupled for movement with one or the other of the two lower belts at the same speed as the lower belt to which it is coupled to effect either the stacking of the sheets or the movement of the stack.

4 Claims, 1 Drawing Figure

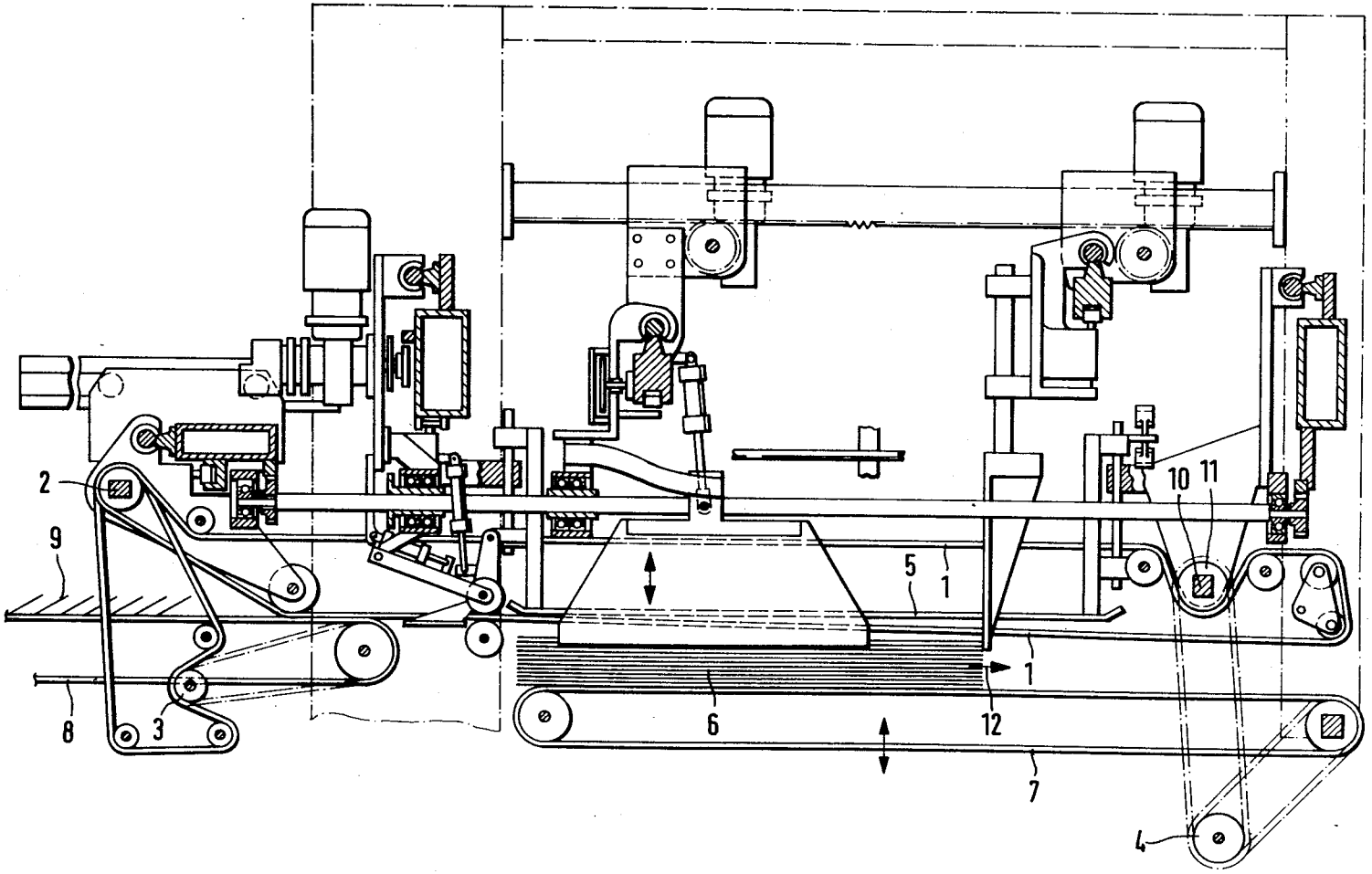
1
1
2
3
4
5
6
7
8
9
10
11
12

DEVICE FOR CONVEYING AND STACKING SHEETS OF PAPER

BACKGROUND OF THE INVENTION

The present invention relates to a device for conveying and stacking sheets of paper and is employed with crosscutting machines, consisting of two conveyor units that are positioned one downstream of the other, that are operated alternately, that can be raised up and down in relation to each other, and that consist of upper and lower belts, whereby the upper and lower belts can be operated at the same speed.

Devices of this type are known. They are described for example in German Offenlegungsschrift No. 3 114 414. The known devices have separate upper belts for carrying the finished stacks of paper out of the device. The upper belts must be accommodated in the minimum possible space in order to save room. There is as a rule space for only one belt per stack, and the belt takes hold of the stack one one side. This results in the drawback that the stacks of paper can get displaced or dislocated while being carried out of the device, necessitating an additional aligning step that is not always successful.

SUMMARY OF THE INVENTION

The object of the present invention is to decrease the expense of manufacturing the upper belts needed for carrying the stacks of paper out of the device while simultaneously allowing them to be carried out of the device in proper alignment.

This object is attained in accordance with the invention in a device for conveying and stacking sheets of paper of the aforesaid type in that a single upper belt is associated with the two lower belts and the upper belt can be shifted over to one or the other of the two lower belts alternately.

The upper belt can be driven alternately by one or the other of two mechanisms, each of which drives one of the lower belts.

The lower section of the upper belt can travel along and below a backing plate.

The backing plate can be mounted in such a way that it can be raised and lowered.

The core of the invention is the concept of exploiting the upper belt, which is already present for conveying the sheets, to carry the sheets out of the device for conveying and stacking sheets of paper. This is possible because the upper belt is driven first by the mechanism that drives one lower belt, the one that conveys the sheets, as well as at the same speed as the first lower belt, and then, when the finished stacks are to be carried out of the device, in synchronization by the mechanism that drives another lower belt, the one that the stack of sheets lies on. The device in accordance with the invention eliminates the extra expense of manufacturing the additional upper belts needed to transport the finished stacks out of conventional devices.

The lower belt in conventional devices is lifted to bring the stack into contact with the upper belt so that the stack can be carried out of the device. In one practical embodiment of the invention it is, however, also possible to lower the upper belt by means of a backing plate until the belt comes into contact with the stack. The backing plate is accordingly mounted in such a way that it can be raised and lowered. Naturally, the lower and upper belts that carry the stack out of the device can also be shifted toward each other during their relative motion.

BRIEF DESCRIPTION OF THE DRAWINGS

A preferred embodiment of the invention will now be described with reference to the attached drawing, which illustrates the embodiment.

DETAILED DESCRIPTION OF THE PREFERRED EMBODIMENTS

The sheets 9 of paper enter the device for conveying and stacking sheets of paper overlapped along a lower belt 8. To ensure orderly transfer of sheets 9 from lower belt 8 to a stack 6, an upper belt 1 takes them over as they arrive at the end of the belt.

Upper belt 1 is coupled during the stacking operation to the mechanism 3 that drives lower belt 8 by means of a coupling 2 and moves at the same speed as lower belt 8. Synchronization of upper belt 1 with lower belt 8 is important for conveying sheets 9 to the stacking point in an orderly way.

When stack 6 has reached the intended height, coupling 2 uncouples upper belt 1 from the mechanism 3 that drives lower belt 8. The takeoff surface is raised along with another lower belt 7 that conveys the stacks until stack 6 is forced against upper belt 1. A lowered backing plate 5 prevents upper belt 1 from yielding. Stack 6 is accordingly compressed between second lower belt 7 and upper belt 1.

Another coupling 10 now couples the pulley 11 that drives upper belt 1 to the mechanism 4 that drives second lower belt 7. Stack 6 is carried out of the device in the direction indicated by arrow 12 between the synchronized belts 1 and 7.

Once the stack has been removed from the device, second coupling 10 uncouples the pulley 11 that drives upper belt 1 from the mechanism 4 that drives lower belt 7 and first coupling 2 couples it again to the mechanism 3 that drives first lower belt 8, the belt that conveys the sheets. Sheets 9 can now, once second lower belt 7 has been lowered into the starting position and backing plate 5 raised, again commence being supplied to the stacking point.

It is understood that the specification and examples are illustrative but not limitative of the present invention and that other embodiments within the spirit and scope of the invention will suggest themselves to those skilled in the art.

What is claimed is:

1. In a device for conveying and stacking sheets of paper having a first conveying unit receptive of sheets for stacking and a second conveying unit downstream of the first conveying unit for removing a stack, wherein the units include upper and lower belts, the improvement wherein a single upper belt is associated with two lower belts for the two units and comprising first coupling means which are engaged to simultaneously drive the upper belt and one of the lower belts at the same speed to effect stacking of the sheets and second coupling means which are engaged to simultaneously drive the upper belt and the other of the lower belts at the same speed to remove the stack, the first and second coupling means being alternately engaged to stack the sheets and then to remove the stack.

2. A device according to claim 1, wherein the upper belt is driven alternately by one or the other of two mechanisms, each of which drives one of the lower belts.

3. A device according to claim 2, wherein the upper belt includes a lower section travelling along and below a backing plate.

4. A device according to claim 3, including means mounting the backing plate so that it can be raised and lowered.

* * * * *